US006691085B1

(12) United States Patent
Rotola-Pukkila et al.

(10) Patent No.: US 6,691,085 B1
(45) Date of Patent: Feb. 10, 2004

(54) METHOD AND SYSTEM FOR ESTIMATING ARTIFICIAL HIGH BAND SIGNAL IN SPEECH CODEC USING VOICE ACTIVITY INFORMATION

(75) Inventors: Jani Rotola-Pukkila, Tampere (FI); Hannu Mikkola, Tampere (FI); Janne Vainio, Lempäälä (FI)

(73) Assignee: Nokia Mobile Phones Ltd., Espoo (FI)

( * ) Notice: Subject to any disclaimer, the term of this patent is extended or adjusted under 35 U.S.C. 154(b) by 321 days.

(21) Appl. No.: 09/691,323

(22) Filed: Oct. 18, 2000

(51) Int. Cl.[7] ..... G10L 21/02

(52) U.S. Cl. ..... 704/228; 704/214; 704/208; 704/226

(58) Field of Search ..... 704/200, 201, 704/200.1, 205–228, 261–268

(56) References Cited

U.S. PATENT DOCUMENTS 5,581,652 A * 12/1996 Abe et al. ..... 704/222
5,867,815 A * 2/1999 Kondo et al. ..... 704/228
6,453,289 B1 * 9/2002 Ertem et al. ..... 704/225

FOREIGN PATENT DOCUMENTS

EP 1008984 6/2000
WO 9938155 7/1999

OTHER PUBLICATIONS

Draft ETSI EN 300 964 V8.0.0 Digital cellular telecommunications system (Phase 2+); Full rate speech; Discontinuous Transmission (DTX) for full rate speech traffic channels.

* cited by examiner

*Primary Examiner*—Richemond Dorvil
*Assistant Examiner*—Abul K. Azad
(74) *Attorney, Agent, or Firm*—Ware, Fressola, Van Der Sluys & Adolphson LLP

(57) ABSTRACT

A method and system for encoding and decoding an input signal, wherein the input signal is divided into a higher frequency band and a lower frequency band in the encoding and decoding processes, and wherein the decoding of the higher frequency band is carried out by using an artificial signal along with speech related parameters obtained from the lower frequency band. In particular, the artificial signal is scaled before it is transformed into an artificial wideband signal containing colored noise in both the lower and the higher frequency band. Additionally, voice activity information is used to define speech periods and non-speech periods of the input signal. Based on the voice activity information, different weighting factors are used to scale the artificial signal in speech periods and non-speech periods.

30 Claims, 6 Drawing Sheets

METHOD AND SYSTEM FOR ESTIMATING ARTIFICIAL HIGH BAND SIGNAL IN SPEECH CODEC USING VOICE ACTIVITY INFORMATION

FIELD OF THE INVENTION

The present invention generally relates to the field of coding and decoding synthesized speech and, more particularly, to such coding and decoding of wideband speech.

BACKGROUND OF THE INVENTION

Many methods of coding speech today are based upon linear predictive (LP) coding, which extracts perceptually significant features of a speech signal directly from a time waveform rather than from a frequency spectra of the speech signal (as does what is called a channel vocoder or what is called a formant vocoder). In LP coding, a speech waveform is first analyzed (LP analysis) to determine a time-varying model of the vocal tract excitation that caused the speech signal, and also a transfer function. A decoder (in a receiving terminal in case the coded speech signal is telecommunicated) then recreates the original speech using a synthesizer (for performing LP synthesis) that passes the excitation through a parameterized system that models the vocal tract. The parameters of the vocal tract model and the excitation of the model are both periodically updated to adapt to corresponding changes that occurred in the speaker as the speaker produced the speech signal. Between updates, i.e. during any specification interval, however, the excitation and parameters of the system are held constant, and so the process executed by the model is a linear-time-invariant process. The overall coding and decoding (distributed) system is called a codec.

In a codec using LP coding to generate speech, the decoder needs the coder to provide three inputs: a pitch period if the excitation is voiced, a gain factor and predictor coefficients. (In some codecs, the nature of the excitation, i.e. whether it is voiced or unvoiced, is also provided, but is not normally needed in case of an Algebraic Code Excited Linear Predictive (ACELP) codec, for example.) LP coding is predictive in that it uses prediction parameters based on the actual input segments of the speech waveform (during a specification interval) to which the parameters are applied, in a process of forward estimation.

Basic LP coding and decoding can be used to digitally communicate speech with a relatively low data rate, but it produces synthetic sounding speech because of its using a very simple system of excitation. A so-called Code Excited Linear Predictive (CELP) codec is an enhanced excitation codec. It is based on "residual" encoding. The modeling of the vocal tract is in terms of digital filters whose parameters are encoded in the compressed speech. These filters are driven, i.e. "excited," by a signal that represents the vibration of the original speaker's vocal cords. A residual of an audio speech signal is the (original) audio speech signal less the digitally filtered audio speech signal. A CELP codec encodes the residual and uses it as a basis for excitation, in what is known as "residual pulse excitation." However, instead of encoding the residual waveforms on a sample-by-sample basis, CELP uses a waveform template selected from a predetermined set of waveform templates in order to represent a block of residual samples. A codeword is determined by the coder and provided to the decoder, which then uses the codeword to select a residual sequence to represent the original residual samples.

FIG. 1 shows elements of a transmitter/encoder system and elements of a receiver/decoder system. The overall system serves as an LP codec, and could be a CELP-type codec. The transmitter accepts a sampled speech signal s(n) and provides it to an analyzer that determines LP parameters (inverse filter and synthesis filter) for a codec. $s_q(n)$ is the inverse filtered signal used to determine the residual x(n). The excitation search module encodes for transmission both the residual x(n), as a quantified or quantized error $x_q(n)$, and the synthesizer parameters and applies them to a communication channel leading to the receiver. On the receiver (decoder system) side, a decoder module extracts the synthesizer parameters from the transmitted signal and provides them to a synthesizer. The decoder module also determines the quantified error $x_q(n)$ from the transmitted signal. The output from the synthesizer is combined with the quantified error $x_q(n)$ to produce a quantified value $s_q(n)$ representing the original speech signal s(n).

A transmitter and receiver using a CELP-type codec functions in a similar way, except that the error $x_q(n)$ is transmitted as an index into a codebook representing various waveforms suitable for approximating the errors (residuals) x(n).

According to the Nyquist theorem, a speech signal with a sampling rate $F_s$ can represent a frequency band from 0 to $0.5F_s$. Nowadays, most speech codecs (coders-decoders) use a sampling rate of 8 kHz. If the sampling rate is increased from 8 kHz, naturalness of speech improves because higher frequencies can be represented. Today, the sampling rate of the speech signal is usually 8 kHz, but mobile telephone stations are being developed that will use a sampling rate of 16 kHz. According to the Nyquist theorem, a sampling rate of 16 kHz can represent speech in the frequency band 0–8 kHz. The sampled speech is then coded for communication by a transmitter, and then decoded by a receiver. Speech coding of speech sampled using a sampling rate of 16 kHz is called wideband speech coding.

When the sampling rate of speech is increased, coding complexity also increases. With some algorithms, as the sampling rate increases, coding complexity can even increase exponentially. Therefore, coding complexity is often a limiting factor in determining an algorithm for wideband speech coding. This is especially true, for example, with mobile telephone stations where power consumption, available processing power, and memory requirements critically affect the applicability of algorithms.

Sometimes in speech coding, a procedure known as decimation is used to reduce the complexity of the coding. Decimation reduces the original sampling rate for a sequence to a lower rate. It is the opposite of a procedure known as interpolation. The decimation process filters the input data with a low-pass filter and then re-samples the resulting smoothed signal at a lower rate. Interpolation increases the original sampling rate for a sequence to a higher rate. Interpolation inserts zeros into the original sequence and then applies a special low-pass filter to replace the zero values with interpolated values. The number of samples is thus increased.

Another prior-art wideband speech codec limits complexity by using sub-band coding. In such a sub-band coding approach, before encoding a wideband signal, it is divided into two signals, a lower band signal and a higher band signal. Both signals are then coded, independently of the other. In the decoder, in a synthesizing process, the two signals are recombined. Such an approach decreases coding complexity in those parts of the coding algorithm (such as the search for the innovative codebook) where complexity increases exponentially as a function of the sampling rate. However, in the parts where the complexity increases linearly, such an approach does not decrease the complexity.

The coding complexity of the above sub-band coding prior-art solution can be further decreased by ignoring the analysis of the higher band in the encoder and by replacing it with filtered white noise, or filtered pseudo-random noise, in the decoder, as shown in FIG. 2. The analysis of the higher band can be ignored because human hearing is not sensitive to the phase response of the high frequency band but only to the amplitude response. The other reason is that only noise-like unvoiced phonemes contain energy in the higher band, whereas the voiced signal, for which phase is important, does not have significant energy in the higher band. In this approach, the spectrum of the higher band is estimated with an LP filter that has been generated from the lower band LP filter. Thus, no knowledge of the higher frequency band contents is sent over the transmission channel, and the generation of higher band LP synthesis filtering parameters is based on the lower frequency band. White noise, an artificial signal, is used as a source for the higher band filtering with the energy of the noise being estimated from the characteristics of the lower band signal. Because both the encoder and the decoder know the excitation, and the Long Term Predictor (LTP) and fixed codebook gains for the lower band, it is possible to estimate the energy scaling factor and the LP synthesis filtering parameters for the higher band from these parameters. In the prior art approach, the energy of wideband white noise is equalized to the energy of lower band excitation. Subsequently, the tilt of the lower band synthesis signal is computed. In the computation of the tilt factor, the lowest frequency band is cut off and the equalized wideband white noise signal is multiplied by the tilt factor. The wideband noise is then filtered through the LP filter. Finally the lower band is cut off from the signal. As such, the scaling of higher band energy is based on the higher band energy scaling factor estimated from an energy scaler estimator, and the higher band LP synthesis filtering is based on the higher band LP synthesis filtering parameters provided by an LP filtering estimator, regardless of whether the input signal is speech or background noise. While this approach is suitable for processing signals containing only speech, it does not function properly when the input signals contains background noise, especially during non-speech periods.

What is needed is a method of wideband speech coding of input signals containing background noise, wherein the method reduces complexity compared to the complexity in coding the full wideband speech signal, regardless of the particular coding algorithm used, and yet offers substantially the same superior fidelity in representing the speech signal.

SUMMARY OF THE INVENTION

The present invention takes advantage of the voice activity information to distinguish speech and non-speech periods of an input signal so that the influence of background noise in the input signal is taken into account when estimating the energy scaling factor and the Linear Predictive (LP) synthesis filtering parameters for the higher frequency band of the input signal.

Accordingly, the first aspect of the method of speech coding for encoding and decoding an input signal having speech periods and non-speech periods and providing synthesized speech having higher frequency components and lower frequency components, wherein the input signal is divided into a higher frequency band and a lower frequency band in encoding and decoding processes, and wherein speech related parameters characteristic of the lower frequency band are used to process an artificial signal for providing the higher frequency components of the synthesized speech, and wherein the input signal includes a first signal in the speech periods and a second signal in the non-speech periods, said method comprising the steps of:

scaling and synthesis filtering the artificial signal in the speech periods based on speech related parameters representative of the first signal; and scaling and synthesis filtering the artificial signal in the non-speech periods based on speech related parameters representative of the second signal, wherein the first signal includes a speech signal and the second signal includes a noise signal.

Preferably, the scaling and synthesis filtering of the artificial signal in the speech periods is also based on a spectral tilt factor computed from the lower frequency components of the synthesized speech.

Preferably, when the input signal includes a background noise, the scaling and synthesis filtering of the artificial signal in the speech periods is further based on a correction factor characteristic of the background noise.

Preferably, the scaling and synthesis filtering of the artificial signal in the non-speech periods is further based on the correction factor characteristics of the background noise.

Preferably, voice activity information is used to indicate the first and second signal periods.

The second aspect of the present invention is a speech signal transmitter and receiver system for encoding and decoding an input signal having speech periods and non-speech periods and providing synthesized speech having higher frequency components and lower frequency components, wherein the input signal is divided into a higher frequency band and a lower frequency band in the encoding and decoding processes, and wherein speech related parameters characteristic of the lower frequency band are used to process an artificial signal for providing the higher frequency components of the synthesized speech an artificial signal, and wherein the input signal includes a first signal in the speech periods and a second signal in the non-speech periods. The system comprises:

a decoder for receiving the encoded input signal and for providing the speech related parameters;

an energy scale estimator, responsive to the speech related parameters, for providing an energy scaling factor for scaling the artificial signal;

a linear predictive filtering estimator, responsive to the speech related parameters, for synthesis filtering the artificial signal; and a mechanism, for providing information regarding the speech and non-speech periods so that the energy scaling factor for the speech periods and the non-speech periods are estimated based on the first and second signals, respectively.

Preferably, the information providing mechanism is capable of providing a first weighting correction factor for the speech periods and a different second weighting correction factor for the non-speech periods so as to allow the energy scale estimator to provide the energy scaling factor based on the first and second weighting correction factors.

Preferably, the synthesis filtering of the artificial signal in the speech periods and the non-speech periods is also based on the first weighting correction factor and the second weighting correction factor, respectively.

Preferably, the speech related parameters include linear predictive coding coefficients representative of the first signal.

The third aspect of the present invention is a decoder for synthesizing speech having higher frequency components and lower frequency components from encoded data indicative of an input signal having speech periods and non-speech periods, wherein the input signal is divided into a higher frequency band and a lower frequency band in the encoding and decoding processes, and the encoding of the input signal is based on the lower frequency band, and wherein the encoded data includes speech parameters characteristic of the lower frequency band for processing an artificial signal and providing the higher frequency components of the synthesized speech. The system comprises:

an energy scale estimator, responsive to the speech parameter, for providing a first energy scaling factor for scaling the artificial signal in the speech periods and a second energy scaling factor for scaling the artificial signal in the non-speech periods; and a synthesis filtering estimator, for providing a plurality of filtering parameters for synthesis filtering the artificial signal.

Preferably, the decoder also comprises a mechanism for monitoring the speech periods and the non-speech periods so as to allow the energy scale estimator to change the energy scaling factors accordingly.

The fourth aspect of the present invention is a mobile station, which is arranged to receive an encoded bit stream containing speech data indicative of an input signal, wherein the input signal is divided into a higher frequency band and a lower frequency band, and the input signal includes a first signal in speech periods and a second signal in non-speech periods, and wherein the speech data includes speech related parameters obtained from the lower frequency band. The mobile station comprises:

a first means for decoding the lower frequency band using the speech related parameters;

a second means for decoding the higher frequency band from an artificial signal;

a third means, responding to the speech data, and for providing information regarding the speech and non-speech periods;

an energy scale estimator, responsive to the speech period information, for providing a first energy scaling factor based on the first signal and a second energy scaling factor based on the second signal for scaling the artificial signal; and a predictive filtering estimator, responsive to the speech related parameters and the speech period information, for providing a first plurality of linear predictive filtering parameters based on the first signal and a second plurality of linear predictive filtering parameters for filtering the artificial signal.

The fifth aspect of the present invention is an element of a telecommunication network, which is arranged to receive an encoded bit stream containing speech data from a mobile station having means for encoding an input signal, where in the input signal is divided into a higher frequency band and a lower frequency band and the input signal includes a first signal in speech periods and a second signal is non-speech periods, and wherein the speech data includes speech related parameters obtained from the lower frequency band. The element comprising:

a first means for decoding the lower frequency band using the speech related parameters;

a second means for decoding the higher frequency band from an artificial signal;

a third means, responding to the speech data, for providing information regarding the speech and non-speech periods, and for providing speech period information;

an energy scale estimator, responsive to the speech period information, for providing a first energy scaling factor based on the first signal and a second energy scaling factor based on the second signal for scaling the artificial signal; and a predictive filtering estimator, responsive to the speech related parameters and the speech period information, for providing a first plurality of linear predictive filtering parameters based on the first signal and a second plurality of linear predictive filtering parameters for filtering the artificial signal.

The present invention will become apparent upon reading the description taken in conjunction with FIGS. 3–6.

BRIEF DESCRIPTION OF THE INVENTION

BEST MODE FOR CARRYING OUT THE INVENTION

Figure 1:
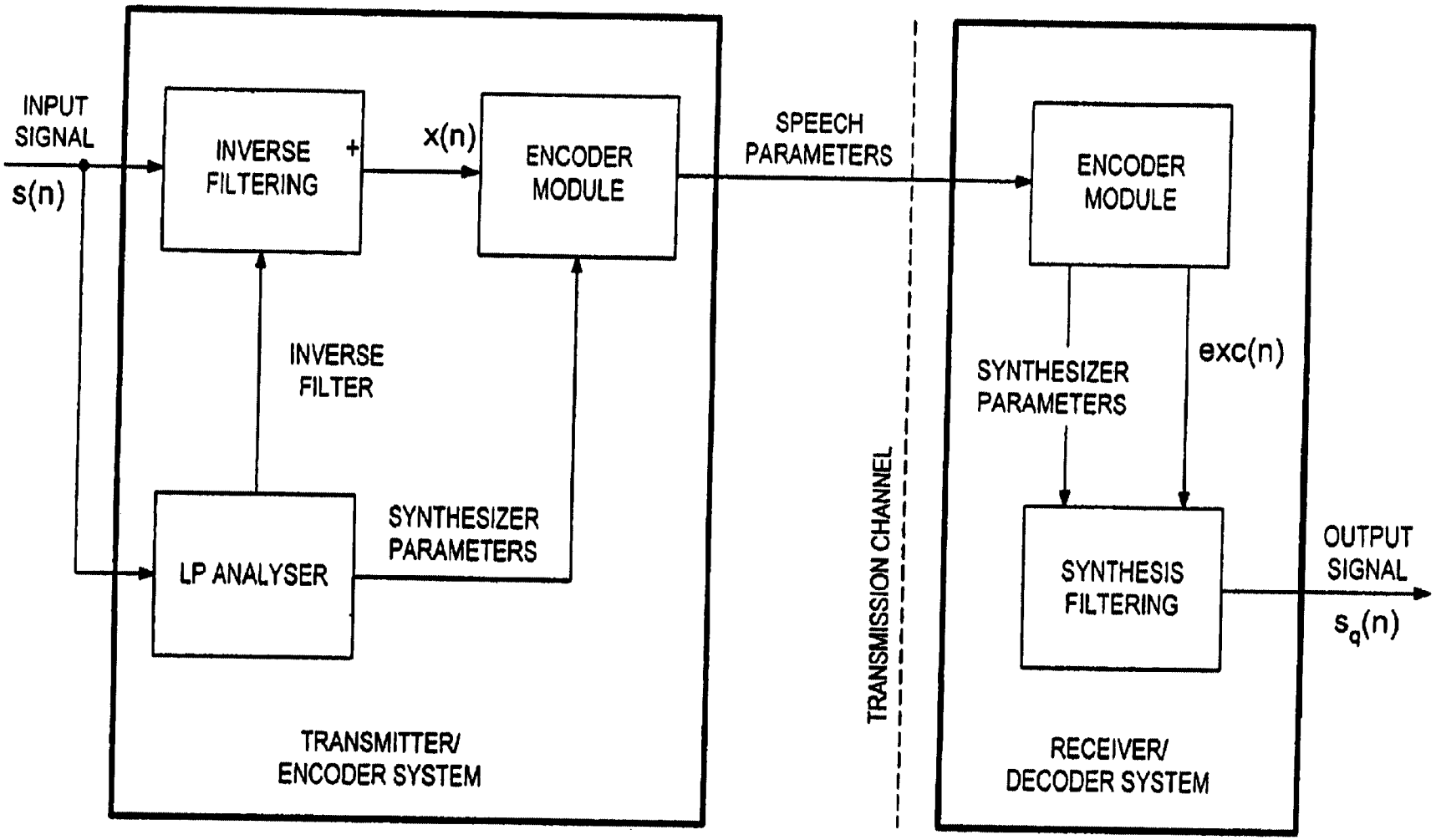
FIG. 1 (Prior Art)
FIG. 1 is a diagrammatic representation illustrating a transmitter and a receiver using a linear predictive encoder and decoder.
Figure 2:
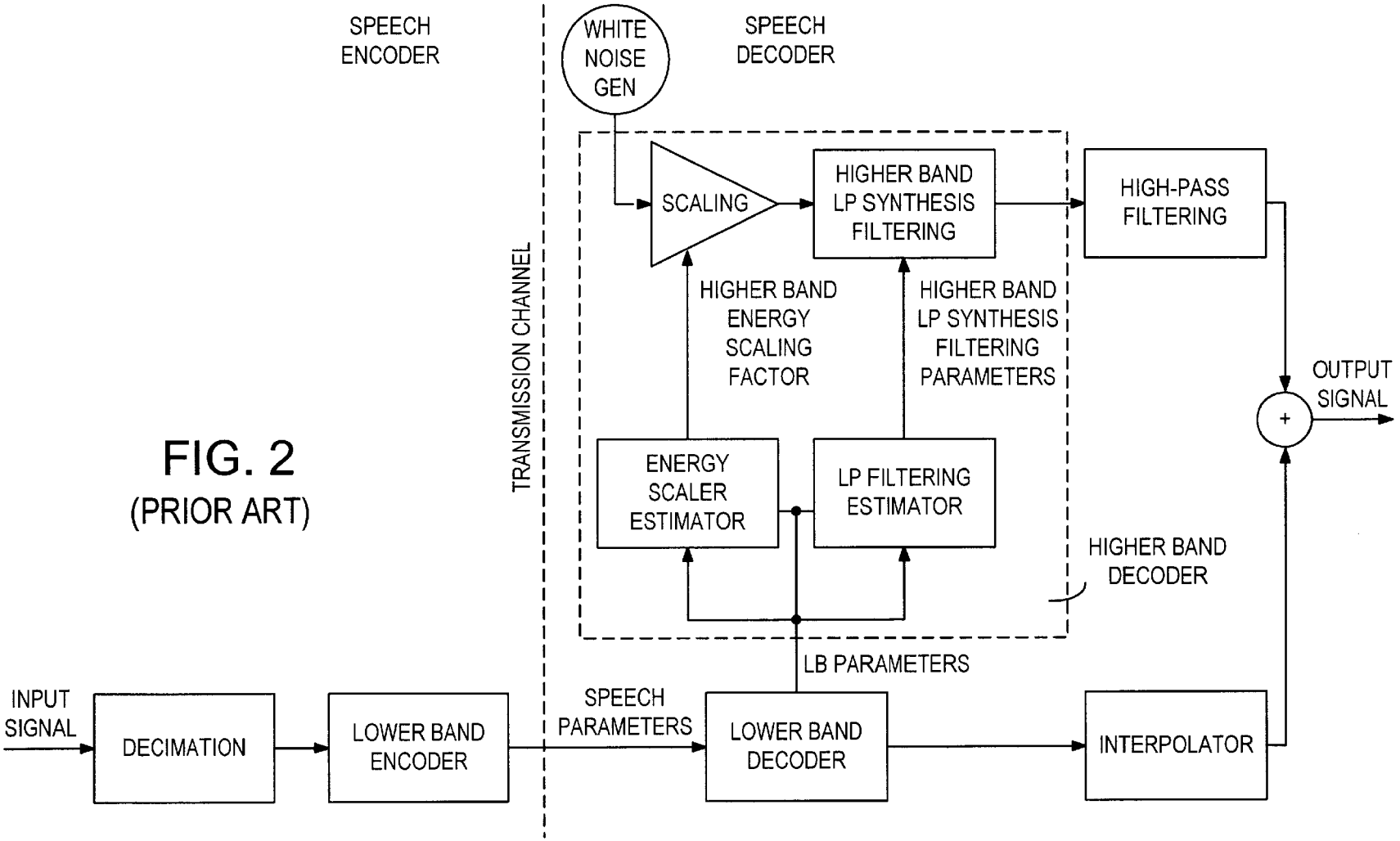
FIG. 2 (PRIOR ART)
FIG. 2 is a diagrammatic representation illustrating a prior-art CELP speech encoder and decoder, wherein white noise is used as an artificial signal for the higher band filtering.
Figure 3:
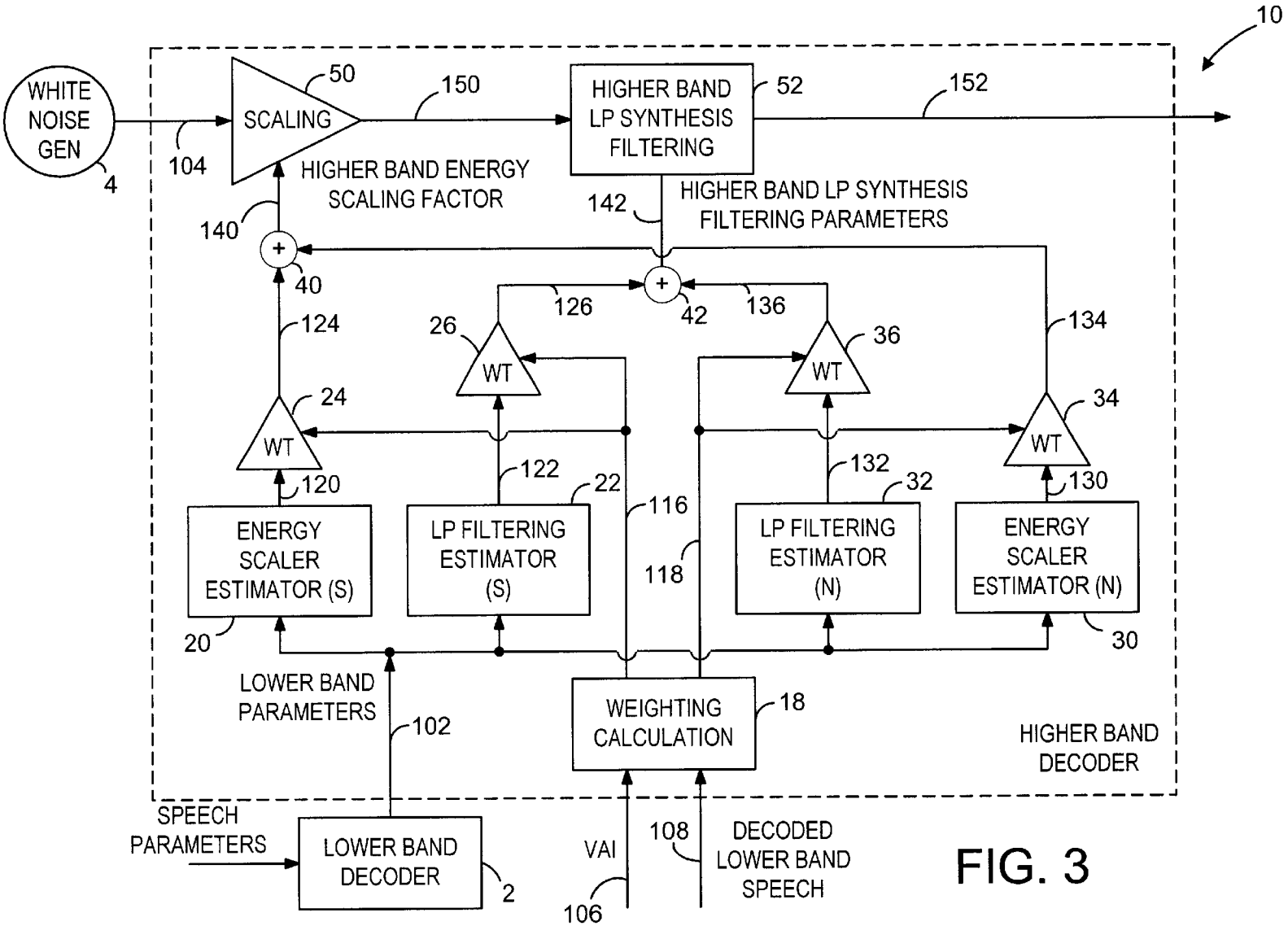
FIG. 3 is a diagrammatic representation illustrating the higher band decoder, according to the present invention.

As shown in FIG. 3, a higher band decoder 10 is used to provide a higher band energy scaling factor 140 and a plurality of higher band linear predictive (LP) synthesis filtering parameters 142 based on the lower band parameters 102 generated from the lower band decoder 2, similar to the approach taken by the prior-art higher-band decoder, as shown in FIG. 2. In the prior-art codec, as shown in FIG. 2, a decimation device is used to change the wideband input signal into a lower band speech input signal, and a lower band encoder is used to analyze a lower band speech input signal in order to provide a plurality of encoded speech parameters. The encoded parameters, which include a Linear Predictive Coding (LPC) signal, information about the LP filter and excitation, are transmitted through the transmission channel to a receiving end which uses a speech decoder to reconstruct the input speech. In the decoder, the lower band speech signal is synthesized by a lower band decoder. In particular, the synthesized lower band speech signal includes the lower band excitation exc(n), as provided by an LB Analysis-by-Synthesis (A-b-S) module (not shown). Subsequently, an interpolator is used to provide a synthesized wideband speech signal, containing energy only in the lower band to a summing device. Regarding the reconstruction of the speech signal in higher frequency band, the higher band decoder includes an energy scaler estimator, an LP filtering estimator, a scaling module, and a higher band LP synthesis filtering module. As shown, the energy scaler estimator provides a higher band energy scaling factor, or gain, to the scaling module, and the LP filtering estimator provides an LP filter vector, or a set of higher band LP synthesis filtering parameters. Using the energy scaling factor, the scaling module scales the energy of the artificial signal, as provided by the white noise generator, to an appropriate level. The higher band LP synthesis filtering module transforms the appropriately scaled white noise into an artificial wideband signal containing colored noise in both the lower and higher frequency bands. A high-pass filter is then used to provide the summing device with an artificial wideband signal containing colored noise only in the higher band in order to produce the synthesized speech in the entire wideband.

In the present invention, as shown in FIG. 3, the white noise, or the artificial signal e(n), is also generated by a white noise generator 4. However, in the prior-art decoder, as shown in FIG. 2, the higher band of the background noise signal is estimated using the same algorithm as that for estimating the higher band speech signal. Because the spectrum of the background noise is usually flatter than the spectrum of the speech, the prior-art approach produces very little energy for the higher band in the synthesized background noise. According to the present invention, two sets of energy scaler estimators and two sets of LP filtering estimators are used in the higher band decoder 10. As shown in FIG. 3, the energy scaler estimator 20 and the LP filtering estimator 22 are used for the speech periods, and the energy scaler estimator 30 and the LP filtering estimator 32 are used for the non-speech periods, all based on the lower band parameters 102 provided by the same lower band decoder 2. In particular, the energy scaler estimator 20 assumes that the signal is speech and estimates the higher band energy as such, and the LP filtering estimator 22 is designed to model a speech signal. Similarly, the energy scaler estimator 30 assumes that the signal is background noise and estimates the higher band energy under that assumption, and the LP filtering estimator 32 is designed to model a background noise signal. Accordingly, the energy scaler estimator 20 is used to provide the higher band energy scaling factor 120 for the speech periods to a weighting adjustment module 24, and the energy scaler estimator 30 is used to provide the higher band energy scaling factor 130 for the non-speech periods to a weighting adjustment module 34. The LP filtering estimator 22 is used to provide higher band LP synthesis filtering parameters 122 to a weighting adjustment module 26 for the speech periods, and the LP filtering estimator 32 is used to provide higher band LP synthesis filtering parameters 132 to a weighting adjustment module 36 for the non-speech periods. In general, the energy scaler estimator 30 and the LP filtering estimator 32 assume that the spectrum is flatter and the energy scaling factor is larger, as compared to those assumed by the energy scaler estimator 20 and the LP filtering estimator 30. If the signal contains both speech and background noise, both sets of estimators are used, but the final estimate is based on the weighted average of the higher band energy scaling factors 120, 130 and weighted average of the higher band LP synthesis filtering parameters 122, 132.

Figure 4:
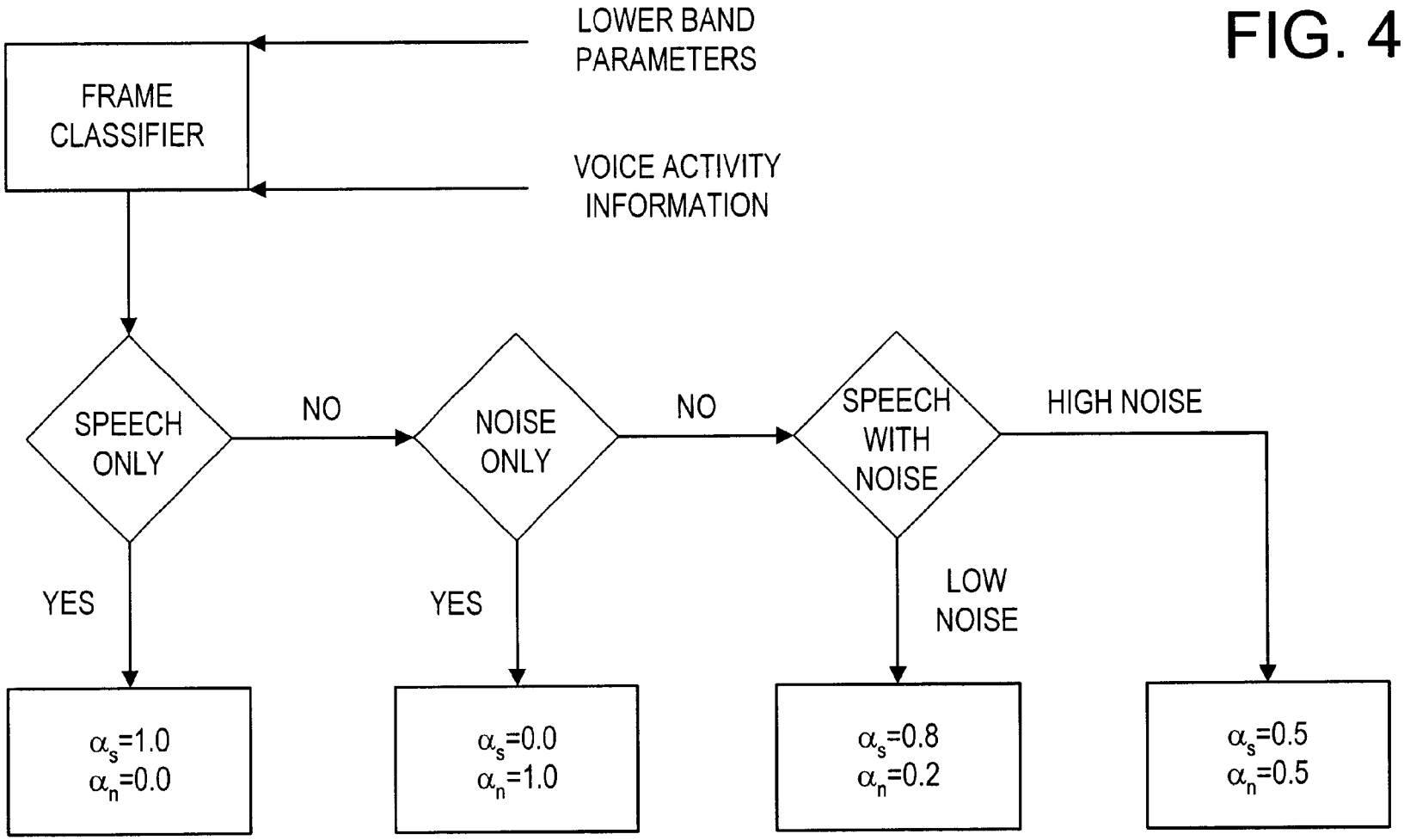
FIG. 4 is flow chart illustrating the weighting calculation according to the noise level in the input signal.

In order to change the weighting of the higher band parameter estimation algorithm between a background noise mode and a speech mode, based on the fact that the speech and background noise signals have distinguishable characteristics, a weighting calculation module 18 uses voice activity information 106 and the decoded lower band speech signal 108 as its input and uses this input to monitor the level of background noise during non-speech periods by setting a weighting factor $\alpha_n$, for noise processing and a weight factor $\alpha_s$ for speech processing, where $\alpha_n+\alpha_s=1$. It should be noted that the voice activity information 106 is provided by a voice activity detector (VAD, not shown), which is well known in the art. The voice activity information 106 is used to distinguish which part of the decoded speech signal 108 is from the speech periods and which part is from the non-speech periods. The background noise can be monitored during speech pauses, or the non-speech periods. It should be noted that, in the case that the voice activity information 106 is not sent over the transmission channel to the decoder, it is possible to analyze the decoded speech signal 108 to distinguish the non-speech periods from the speech periods. When there is a significant level of background noise detected, the weighting is stressed towards the higher band generation for the background noise by increasing the weighting correction factor $\alpha_n$ and decreasing the weighting correction actor 60 $_s$ as shown in FIG. 4. The weighting can be carried out, for example, according to the real proportion of the speech energy to noise energy (SNR). Thus, the weighting calculation module 18 provides a weighting correction factor 116, or $\alpha_s$, for the speech periods to the weighting adjustment modules 24, 26 and a different weighting correction factor 118, or $\alpha_n$, for the non-speech periods to the weighting adjustment modules 34, 36. The power of the background noise can be found out, for example, by analyzing the power of the synthesized signal, which is contained in the signal 102 during the non-speech periods. Typically, this power level is quite stable and can be considered a constant. Accordingly, the SNR is the logarithmic ratio of the power of the synthesized speech signal to the power of background noise. With the weighting correction factors 116 and 118, the weighting adjustment module 24 provides a higher band energy scaling factor 124 for the speech periods, and the weighting adjustment module 34 provides a higher band energy scaling factor 134 for the non-speech periods to the summing module 40. The summing module 40 provides a higher band energy scaling factor 140 for both the speech and non-speech periods. Likewise, the weighting adjustment module 26 provides the higher band LP synthesis filtering parameters 126 for the speech periods, and the weighting adjustment module 36 provides the higher band LP synthesis filtering parameters 136 to a summing device 42. Based on these parameters, the summing device 42 provides the higher band LP synthesis filtering parameters 142 for both the speech and non-speech periods. Similar to their counterparts in the prior art higher band encoder, as shown in FIG. 2, a scaling module 50 appropriately scales the energy of the artificial signal 104 as provided by the white noise generator 4, and a higher band LP synthesis filtering module 52 transforms the white noise into an artificial wideband signal 152 containing colored noise in both the lower and higher frequency bands. The artificial signal with energy appropriately scaled is denoted by reference numeral 150.

One method to implement the present invention is to increase the energy of the higher band for background noise based on higher band energy scaling factor 120 from the energy scaler estimator 20. Thus, the higher band energy scaling factor 130 can simply be the higher band energy scaling factor 120 multiplied by a constant correction factor $C_{corr}$. For example, if the tilt factor $c_{tilt}$, used by the energy scaler estimator 20 is 0.5 and the correction factor $C_{corr}=2.0$, then the summed higher band energy factor 140, or $\alpha_{sum}$, can be calculated according to the following equation:

$$\alpha_{sum}=\alpha_s c_{tilt}+\alpha_n c_{tilt} c_{corr} \quad (1)$$

If the weighting correction factor 116, or $\alpha_s$, is set equal to 1.0 for speech only, 0.0 for noise only, 0.8 for speech with a low level of background noise, and 0.5 for speech with a high level of background noise, the summed higher band energy factor $\alpha_{sum}$ is given by:

$\alpha_{sum}=1.0\times0.5+0.0\times0.5\times2.0=0.5$ (for speech only)

$\alpha_{sum}=0.0\times0.5+1.0\times0.5\times2.0=1.0$ (for noise only)

$\alpha_{sum}=0.8\times0.5+0.2\times0.5\times2.0=0.6$ (for speech with low background noise)

$\alpha_{sum}=0.5\times0.5+0.5\times0.5\times2.0=0.75$ (for speech with high background noise)

Figure 5:
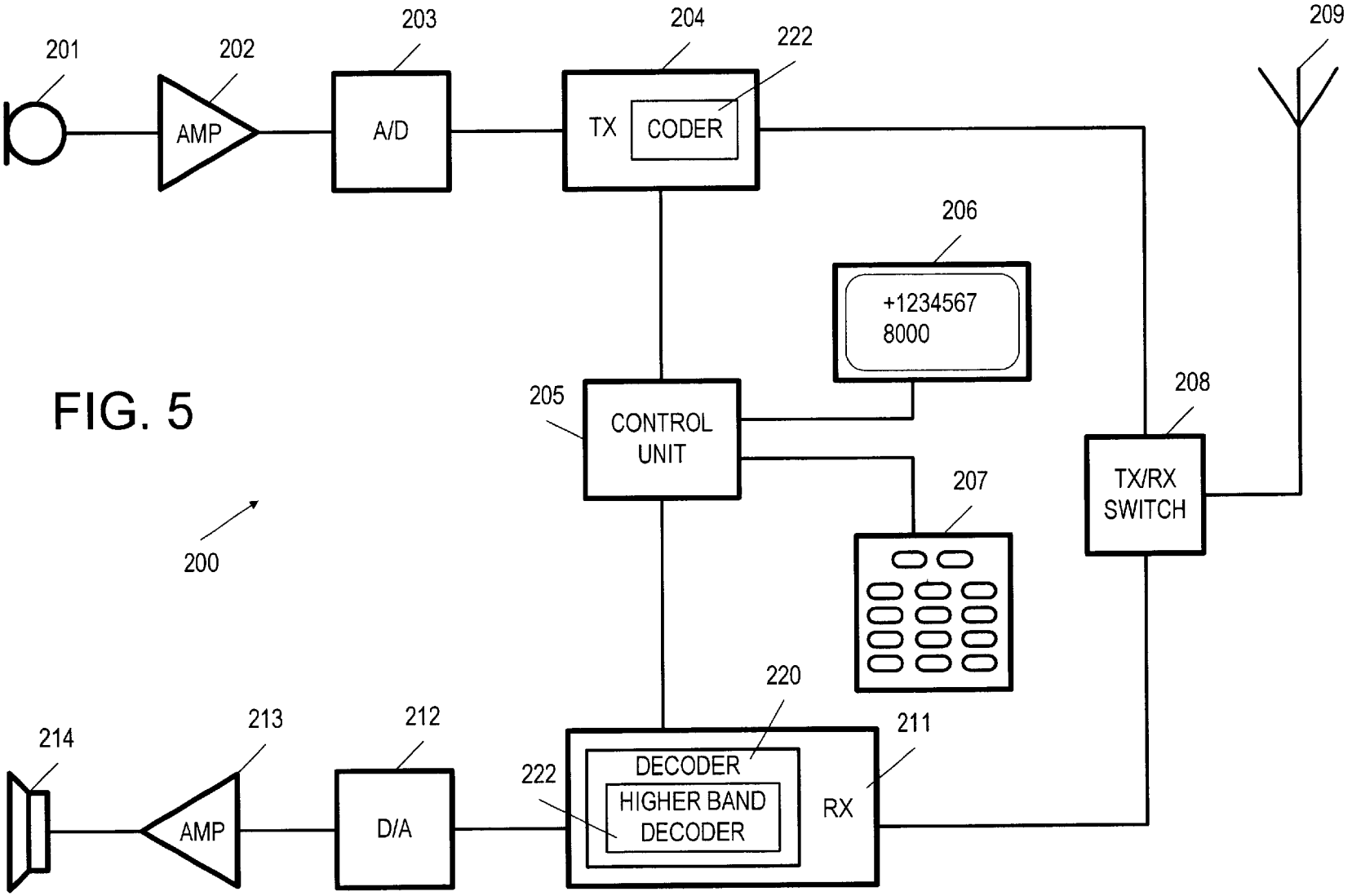
FIG. 5 is a diagrammatic representation illustrating a mobile station, which includes a decoder, according to the present invention.

The exemplary implementation is illustrated in FIG. 5. This simple procedure can enhance the quality of the synthesized speech by correcting the energy of the higher band. The correction factor $c_{corr}$ is used here because the spectrum of background noise is usually flatter than and the spectrum of speech. In speech periods, the effect of the correction factor $c_{corr}$ is not as significant as in non-speech periods because of the low value of $c_{tilt}$. In this case, the value of $c_{tilt}$ is designed for speech signal as in prior art.

It is possible to adaptively change the tilt factor according to the flatness of the background noise. In a speech signal, tilt is defined as the general slope of the energy of the frequency domain. Typically, a tilt factor is computed from the lower band synthesis signal and is multiplied to the equalized wideband artificial signal. The tilt factor is estimated by calculating the first autocorrelation coefficient, r, using the following equation:

$$r=\{s^T(n)s(n-1)\}/\{s^T(n)s(n)\} \quad (2)$$

where s(n) is the synthesized speech signal. Accordingly, the estimated tilt factor $c_{tilt}$ is determined from $c_{tilt}=1.0-r$, with $0.2\leqq c_{tilt}\leqq 1.0$, and the superscript T denotes the transpose of a vector.

It is also possible to estimate the scaling factor from the LPC excitation exc(n) and the filtered artificial signal e(n) as follows:

$$e_{scaled}=\text{sqrt}\,[\{exc^T(n)\ exc(n)\}/\{e^T(n)\ e(n)\}]e(n) \quad (3)$$

The scaling factor sqrt $[\{exc^T(n)\ exc(n)\}/\{e^T(n)\ e(n)\}]$ is denoted by reference numeral 140, and the scaled white noise $e_{scaled}$ is denoted by reference numeral 150. The LPC excitation, the filtered artificial signal and the tilt factor can be contained in signal 102.

It should be noted that the LPC excitation exc(n), in the speech periods is different from the non-speech periods. Because the relationship between the characteristics of the lower band signal and the higher band signal is different in speech periods from non-speech periods, it is desirable to increase the energy of the higher band by multiplying the tilt factor $c_{tilt}$ by the correction factor $c_{corr}$. In the above-mentioned example (FIG. 4), $c_{corr}$ is chosen as a constant 2.0. However, the correction factor $c_{corr}$ should be chosen such that $0.1\leqq c_{tilt}c_{corr}\leqq<1.0$. If the output signal 120 of the energy scaler estimator 120 is $c_{tilt}$, then the output signal 130 of the energy scaler estimator 130 is $c_{tilt}\ c_{corr}$.

One implementation of the LP filtering estimator 32 for noise is to make the spectrum of the higher band flatter when background noise does not exist. This can be achieved by adding a weighting filter $W_{HB}(z)=\hat{A}(z/\beta_1)/\hat{A}(z/\beta_2)$ after the generated wideband LP filter, where $\hat{A}(z)$ is the quantized LP filter and $0>\beta_1\geqq\beta_2>1$. For example, $\alpha_{sum}=\alpha_s\beta_1+\alpha_n\beta_2 c_{corr}$, with $\beta_1=0.5$, $\beta_2=0.5$ (for speech only)

$\beta_1=0.8$, $\beta_2=0.5$ (for noise only)

$\beta_1=0.56$, $\beta_2=0.46$ (for speech with low background noise)

$\beta_1=0.65$, $\beta_2=0.40$ (for speech with high background noise)

It should be noted that when the difference between $\beta_1$ and $\beta_2$ becomes larger, the spectrum becomes flatter, and the weighting filter cancels out the effect of the LP filter.

FIG. 5 shows a block diagram of a mobile station 200 according to one exemplary embodiment of the invention. The mobile station comprises parts typical of the device, such as microphone 201, keypad 207, display 206, earphone 214, transmit/receive switch 208, antenna 209 and control unit 205. In addition, the figure shows transmit and receive blocks 204, 211 typical of a mobile station. The transmission block 204 comprises a coder 221 for coding the speech signal. The transmission block 204 also comprises operations required for channel coding, deciphering and modulation as well as RF functions, which have not been drawn in FIG. 5 for clarity. The receive block 211 also comprises a decoding block 220 according to the invention. Decoding block 220 comprises a higher band decoder 222 like the higher band decoder 10 shown in FIG. 3. The signal coming from the microphone 201, amplified at the amplification stage 202 and digitized in the A/D converter, is taken to the transmit block 204, typically to the speech coding device comprised by the transmit block. The transmission signal processed, modulated and amplified by the transmit block is taken via the transmit/receive switch 208 to the antenna 209. The signal to be received is taken from the antenna via the transmit/receive switch 208 to the receiver block 211, which demodulates the received signal and decodes the deciphering and the channel coding. The resulting speech signal is taken via the D/A converter 212 to an amplifier 213 and further to an earphone 214. The control unit 205 controls the operation of the mobile station 200, reads the control commands given by the user from the keypad 207 and gives messages to the user by means of the display 206.

Figure 6:
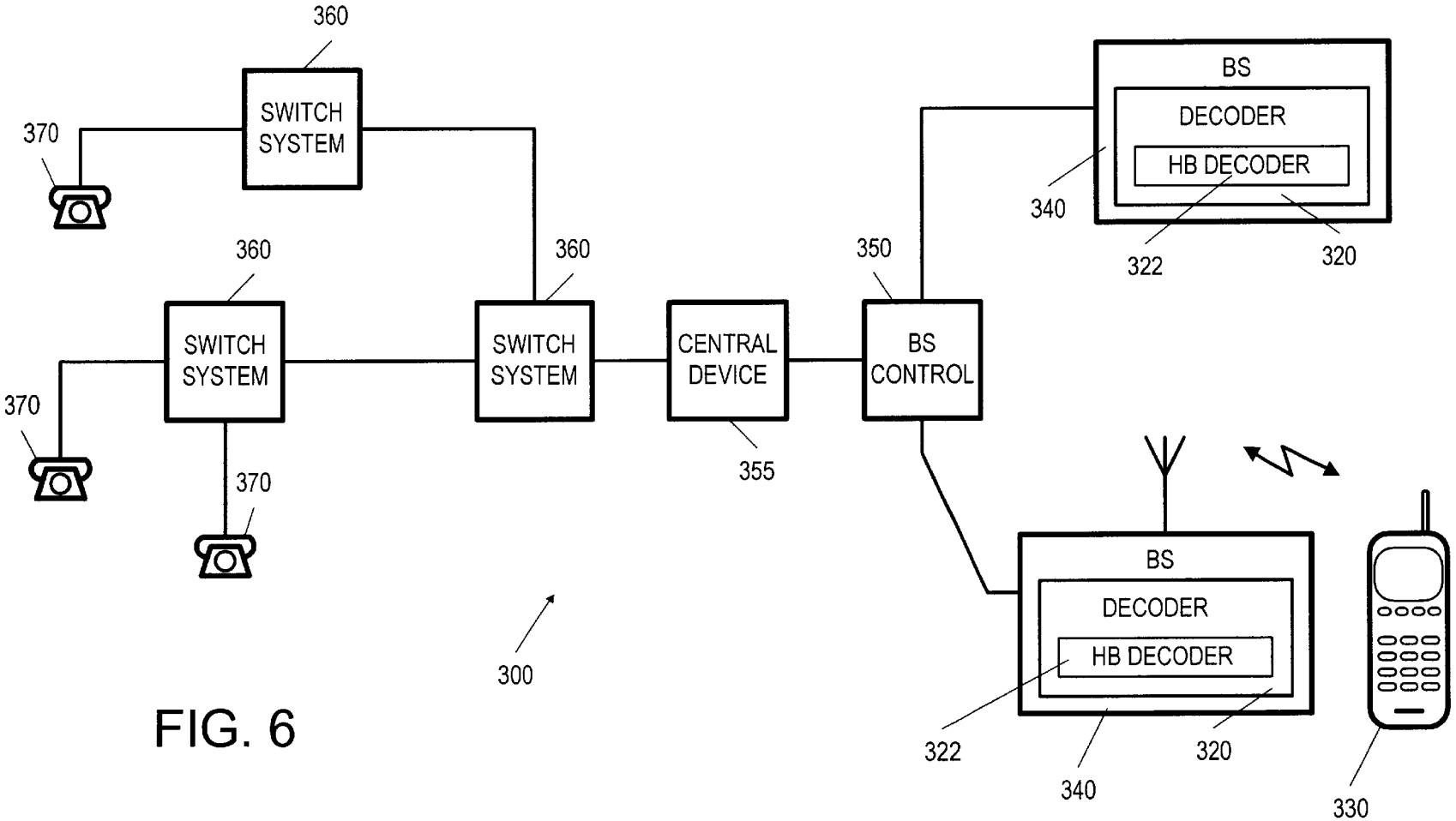
FIG. 6 is a diagrammatic representation illustrating a telecommunication network using a decoder, according to the present invention.

The higher band decoder 10, according to the invention, can also be used in a telecommunication network 300, such as an ordinary telephone network or a mobile station network, such as the GSM network. FIG. 6 shows an example of a block diagram of such a telecommunication network. For example, the telecommunication network 300 can comprise telephone exchanges or corresponding switching systems 360, to which ordinary telephones 370, base stations 340, base station controllers 350 and other central devices 355 of telecommunication networks are coupled. Mobile stations 330 can establish connection to the telecommunication network via the base stations 340. A decoding block 320, which includes a higher band decoder 322 similar to the higher band decoder 10 shown in FIG. 3, can be particularly advantageously placed in the base station 340, for example. However, the decoding block 320 can also be placed in the base station controller 350 or other central or switching device 355, for example. If the mobile station system uses separate transcoders, e.g., between the base stations and the base station controllers, for transforming the coded signal taken over the radio channel into a typical 64 kbit/s signal transferred in a telecommunication system and vice versa, the decoding block 320 can also be placed in such a transcoder. In general the decoding block 320, including the higher band decoder 322, can be placed in any element of the telecommunication network 300, which transforms the coded data stream into an uncoded data stream. The decoding block 320 decodes and filters the coded speech signal coming from the mobile station 330, whereafter the speech signal can be transferred in the usual manner as uncompressed forward in the telecommunication network 300.

The present invention is applicable to CELP type speech codecs and can be adapted to other type of speech codecs as well. Further more, it is possible to use in the decoder, as shown in FIG. 3, only one energy scaler estimator to estimate the higher band energy, or one LP filtering estimator to model speech and background noise signal.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method of speech coding for encoding and decoding an input signal having speech periods and non-speech periods for providing synthesized speech having higher frequency components and lower frequency components, wherein the input signal is divided into a higher frequency band and a lower frequency band in encoding and decoding processes, and wherein speech related parameters characteristic of the lower frequency band are used to process an artificial signal for providing the higher frequency components of the synthesized speech, and wherein voice activity information having a first signal and a second signal is used to indicate the speech periods and the non-speech periods, said method comprising the step of:

scaling the artificial signal in the speech periods and the non-speech periods based on the voice activity information indicating the first and second signals, respectively.

2. The method of claim 1, further comprising the steps of;

synthesis filtering the artificial signal in the speech periods based on the speech related parameters representative of the first signal; and synthesis filtering the artificial signal the non-speech periods based on the speech related parameters representative of the second signal.

3. The method of claim 1, wherein the first signal includes a speech signal and the second signal includes a noise signal.

4. The method of claim 3, wherein the first signal further includes the noise signal.

5. The method of claim 1, wherein the speech periods and the non-speech periods are defined by a voice activity detection means based on the input signal.

6. The method of claim 1, wherein the speech related parameters include linear predictive coding coefficients representative of the first signal.

7. The method of claim 1, wherein the scaling of the artificial signal in the speech periods is further based on a spectral tilt factor computed from the lower frequency components of the synthesized speech.

8. The method of claim 7, wherein the input signal includes a background noise, and wherein the scaling of the artificial signal in the speech periods is further based on a correction factor characteristic of the background noise.

9. The method of claim 8, wherein the scaling of the artificial signal in the non-speech periods is further based on the correction factor.

10. A speech signal transmitter and receiver system for encoding and decoding an input signal having speech periods and non-speech periods for providing synthesized speech having higher frequency components and lower frequency components, wherein the input signal is divided into a higher frequency band and a lower frequency band in the encoding and decoding processes, and speech related parameters characteristic of the lower frequency band are used to process an artificial signal for providing the higher frequency components of the synthesized speech, and wherein voice activity information having a first signal and a second signal is used to indicate the speech periods and non-speech periods, said system comprising:

a decoder for receiving the encoded input signal and for providing the speech related parameters;

an energy scale estimator, responsive to the speech related parameters, for providing an energy scaling factor for scaling the artificial signal in the speech periods and the non-speech periods based on the voice activity information indicating the first and second signals, respectively; and a linear predictive filtering estimator, also responsive to the speech related parameters, for synthesis filtering the artificial signal.

11. The system of claim 10, wherein the information providing means monitors the speech and non-speech periods based on voice activity information of the input speech.

12. The system of claim 10, wherein the information providing means is capable of providing a first weighting correction factor for the speech periods and a different second weighting correction factor for the non-speech periods so as to allow the energy scale estimator to provide the energy scaling factor based on the first and second weighting correction factors.

13. The system of claim 12, wherein the synthesis filtering of the artificial signal in the speech periods and the non-speech periods is based on the first weighting correction factor and the second weighting correction factor, respectively.

14. The system of claim 10, wherein the input signal includes a first signal in the speech periods and a second signal in the non-speech period, and wherein the first signal includes a speech signal and the second signal includes a noise signal.

15. The system of claim 14, wherein the first signal further includes the noise signal.

16. The system of claim 10, wherein the speech related parameters include linear predictive coding coefficients representative of the first signal.

17. The system of claim 10, wherein the energy scaling factor for the speech periods is also estimated from the spectral tilt factor of the lower frequency components of the synthesized speech.

18. The system of claim 17, wherein the input signal includes a background noise, and wherein the energy scaling factor for the speech periods is further estimated from a correction factor characteristic of the background noise.

19. The system of claim 18, wherein the energy scaling factor for the non-speech periods is further estimated from the correction factor.

20. A decoder for synthesizing speech having higher frequency components and lower frequency components from encoded data indicative of an input signal having speech periods and non-speech periods, wherein the input signal is divided into a higher frequency band and a lower frequency band in the encoding and decoding processes, and the encoding of the input signal is based on the lower frequency band, and wherein the encoded data includes speech parameters characteristic of the lower frequency band for use in processing an artificial signal for providing the higher frequency components of the synthesized speech, and voice actively information having a first signal and a second signal is used to indicate the speech periods and non-speech periods, said decoder comprising:

an energy scale estimator, responsive to the speech parameter, for providing a first energy scaling factor for scaling the artificial signal in the speech periods when the voice activity information indicates the first signal, and a second energy scaling factor for scaling the artificial signal in the non-speech periods when the voice activity information indicates the second signal; and a synthesis filtering estimator, for providing a plurality of filtering parameters for synthesis filtering the artificial signal.

21. The decoder of claim 20, further comprising means for monitoring the speech periods and the non-speech periods.

22. The decoder of claim 20, wherein the input signal includes a first signal in speech periods and a second signal in non-speech periods, wherein the first energy scaling factor is estimated based on the first signal and the second energy scaling factor is estimated based on the second signal.

23. The decoder of claim 22, wherein the filtering parameters for the speech periods and the non-speech periods are estimated from the first and second signals, respectively.

24. The decoder of claim 22, wherein the first energy scaling factor is further estimated based on a spectral tilt factor characteristic of the lower frequency components of the synthesized speech.

25. The decoder of claim 22, wherein the first signal includes a background noise, and wherein the first energy scaling factor is further estimated based on a correction factor characteristic of the background noise.

26. The decoder of claim 25, wherein the second energy scaling factor is further estimated from the correction factor.

27. A mobile station, which is arranged to receive an encoded bit stream containing speech data indicative of an input signal, wherein the input signal is divided into a higher frequency band and a lower frequency band, and voice activity information having a first signal and a second signal is used to indicate speech periods and non-speech periods, and wherein the speech data includes speech related parameters obtained from the lower frequency band, said mobile station comprising:

a first means, responsive to the encoded bit stream, for decoding the lower frequency band using the speech related parameters;

a second means, responsive to the encoded bit stream, for decoding the higher frequency band from an artificial signal;

an energy scale estimator, responsive to the voice activity information, for providing a first energy scaling factor for scaling the artificial signal in the speech periods and a second energy scaling factor for scaling the artificial signal in the non-speech periods based on the voice activity information having the first signal and the second signal, respectively.

28. The mobile station of claim 27, further comprising:

a predictive filtering estimator, responsive to the speech related parameters and the voice activity information, for providing a first plurality of linear predictive filtering parameters based on the first signal and a second plurality of linear predictive filtering parameters for filtering the artificial signal.

29. An element of a telecommunication network, which is arranged to receive an encoded bit stream containing speech data indicative of an input signal from a mobile station, wherein the input signal is divided into a higher frequency band and a lower frequency band and the speech data includes speech related parameters obtained from the lower frequency band, and wherein voice activity information having a first signal and a second signal is used to indicate the speech periods and the non-speed periods, said element comprising:

a first means for decoding the lower frequency band using the speech related parameters;

a second means for decoding the higher frequency band from an artificial signal;

a third means, responsive to the speech data, for providing information regarding the speech and non-speech periods; and an energy scale estimator, responsive to the speech period information, for providing a first energy scaling factor for scaling the artificial signal in the speech periods and a second energy scaling factor for scaling the artificial signal in the non-speech periods based on the voice activity information having the first or second signal.

30. The element of claim 29, further comprising:

a predictive filtering estimator, responsive to the speech related parameters and the speech period information, for providing a first plurality of linear predictive filtering parameters based on the first signal and a second plurality of linear predictive filtering parameters for filtering the artificial signal.

* * * * *